United States Patent [19]

Graham

[11] 4,228,755

[45] Oct. 21, 1980

[54] SAIL SUPPORTS

[76] Inventor: Robert G. Graham, 12 Half Moon Rise, Bucklands Beach, Auckland, New Zealand

[21] Appl. No.: 969,171

[22] Filed: Dec. 13, 1978

[30] Foreign Application Priority Data

Dec. 14, 1977 [NZ] New Zealand ..... 185968
Apr. 28, 1978 [NZ] New Zealand ..... 187110

[51] Int. Cl.[3] ..... B63H 9/10

[52] U.S. Cl. ..... 114/111; 114/105; 114/113

[58] Field of Search ..... 114/39, 89, 90, 102, 114/103, 104, 105, 108, 111, 112, 113; 52/726; 116/173, 174

[56] References Cited

U.S. PATENT DOCUMENTS

| | | | |
|---|---|---|---|
| 1,798,772 | 3/1931 | Wood | 114/112 |
| 2,724,356 | 11/1955 | Szakacs | 114/102 X |
| 2,925,798 | 2/1960 | Colgate | 114/102 |
| 3,058,138 | 10/1962 | Tomlinson | 114/112 X |
| 3,112,725 | 12/1963 | Malrose | 114/90 X |
| 3,331,348 | 7/1967 | Dyer | 114/90 |
| 3,371,458 | 3/1968 | Sturgill | 52/726 X |
| 3,800,728 | 4/1974 | Dowling | 114/105 |
| 3,802,206 | 4/1974 | Moore et al. | 52/726 X |
| 3,851,609 | 12/1974 | Stearn | 114/105 |
| 3,948,200 | 4/1976 | Hood et al. | 114/105 |

FOREIGN PATENT DOCUMENTS

| | | | |
|---|---|---|---|
| 2329507 | 5/1977 | France | 114/90 |

*Primary Examiner*—Galen L. Barefoot

[57] ABSTRACT

A yacht foresail or mainsail support and change-over device. The support comprises at least two tracks on which said slides are slidingly captivated. The support is mounted against longitudinal movement with the lower end thereof upwardly of the lower end of the supporting fixture. A sail slide storage magazine is detachably mounted to the lower end of the support. The magazine incorporates a track(s) complementary to and abutting with the tracks of the support. Thus, a sail can be pre-loaded in the magazine and, with mounting to the support as aforesaid, raised. At the same time, conventionally immediately thereafter, a previously raised sail can be lowered into the empty magazine in readiness for re-raising or storage therewith.

7 Claims, 3 Drawing Figures

SAIL SUPPORTS

BACKGROUND OF THE INVENTION

This invention relates to a yacht sail supporting device including means enabling the ready change-over from one sail to another. The device is suitable for utilisation with either a headsail, for example, a foresail rigged to a track mounted forestay or a mast rigged mainsail.

The preparation of a fresh sail in readiness for changing-over thereto from an existing raised sail and the storage of such a replaced sail are two major skills and tasks in sailing. For safety such a sail substitution operation is preferably carried out promptly and, in particular in racing circumstances, it is well recognised quick sail raising, lowering and changing is critical to maintain boat speed and if nothing else good seamanship.

SUMMARY OF THE INVENTION

The intention of this invention is to provide an apparatus for supporting a headsail or mainsail enabling the ready change-over of one headsail or mainsail for another. The apparatus enables the pre-loading of a sail in readiness for raising and, with change-over of sails, the at least partially furled containment of a lowered sail in readiness for re-raising or stowage.

Conventionally a foresail or headsail is supported and mounted by the leading or luff rope edge thereof to a wire stay or track by hanks clipped about the stay or slides mounted endways on the track as the case may be. In raising and lowering a sail the hanks or slides travel along the stay/track. A reverse procedure is utilised to remove sails so mounted.

In recent times devices have been developed to include both single and double tracks mounted themselves to a forestay and including feeder line loading tracks. A dual-track sail support enables a replacement sail to be raised alongside an existing sail prior to the lowering thereof to thereby maintain raised sail area. U.S. Pat. Nos. 3,658,025, 3,851,608 and 3,851,609 disclose this type of apparatus, the teachings thereof being primarily directed to the luff rope edge of a sail being accommodated in the track or tracks with the latter two Patents making a brief reference to the use of sail slides. Such prior art makes no reference to storage of a sail in a pre-loaded state to enable immediate raising when required without the need to also simultaneously feed the sail from the feeder track onto the sail support track or tracks. Conversely, when a sail is lowered the prior art does not disclose any means or method by which the sail can be stored in and at least partially furled nature and in particular in a pre-loaded manner in readiness for subsequent re-raising or storage as required.

U.S. Pat. Nos. 2,925,798 describes the use of a hank storage magazine by which sprung hanks can be loaded onto a wire stay. The magazine is not capable of directly receiving the hanks of a lowered sail.

U.S. Pat. No. 3,800,728 discloses the use of sail support slides in a single track mounted to a wire stay and having a lower track section which is removable. This enables a sail to be stored in a pre-loaded state in readiness for mounting to the parent track. Such a device would not function with a dual-track sail support as the detachable section cannot be removed when a sail is raised. Thus its incorporation in a dual-track sail support would not enable the benefits of a dual-track, as discussed above, to be obtained.

According to a first aspect of this invention there is provided a sail loading and unloading magazine for an at least two track sail support broadly comprising an elongate element incorporating at least one longitudinally disposed track terminating co-terminus with the magazine at one end thereof, a pair of longitudinally spaced apart stops on each track by which sail slides can be captivated thereon and with the stop nearer the co-terminus end of the magazine being removable, and attachment means enabling the magazine to be detachably mounted, in end to end relationship, to an at least two track sail support with the magazine track(s) substantially aligned with and abutting the end(s) of the tracks or a selected track of the sail support.

According to a second aspect of this invention there is provided a foresail or headsail support and change-over device comprising an elongate sail support with at least two parallel and longitudinally extending sail tracks thereon with each track being adapted to slidingly retain sail slides clear of sail slides on an adjacent track, sail support mounting means for attaching, in longitudinal conformity, the sail support to or as an elongate substantially upright fixture of a yacht with the lower end of the sail support clear of the lower end of the fixture, characterised in that, the sail support mounting means prevents longitudinal movement of the track element whereby a sail slide storage magazine incorporating at least one longitudinally disposed slide storage track complementary to the tracks of the sail support and terminating co-terminus with the magazine at one end thereof can be detachably mounted, in end to end abutting relationship, to the lower end of the sail support element with the magazine track(s) substantially in alignment with the tracks or a selected track thereof, the magazine incorporating a pair of longitudinally spaced apart stops to retain sail slides thereon with the stop nearer the sail support abutting end of the magazine being removable.

BRIEF DESCRIPTION OF THE DRAWINGS

In further describing the invention by way of a preferred embodiment reference is made to the accompanying drawings wherein.

DETAILED DISCLORURE OF THE INVENTION

Figures 1, 2, 3:
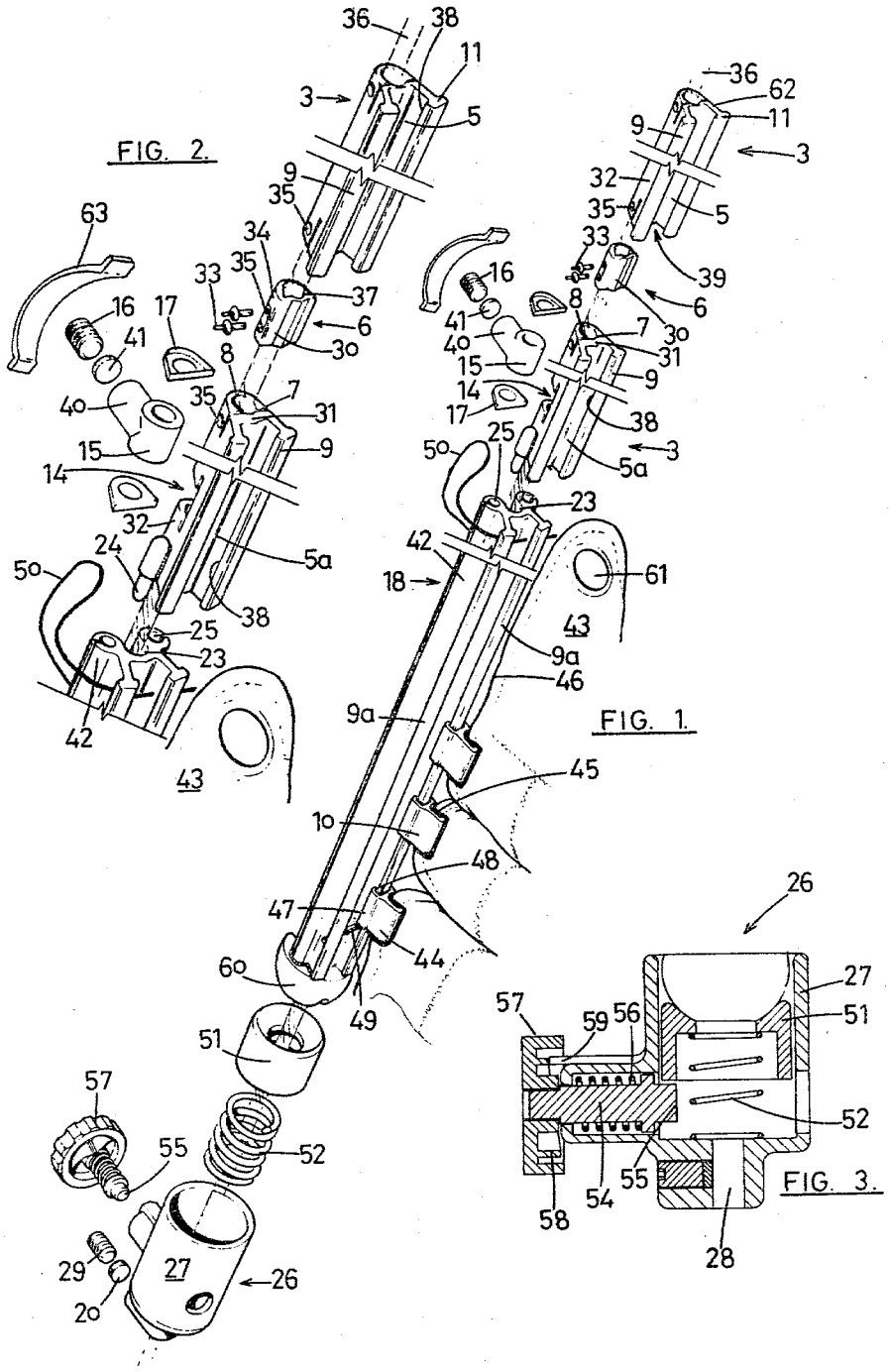
FIG. 1 is an exploded perspective assembly view of the device.
FIG. 2 is an enlarged view, for the purposes of clarity, of the upper portion of FIG. 1.
FIG. 3 is a cross-sectional view of detachable mounting means for the magazine of the device.

In a preferred embodiment of the device is designed for use with a foresail and is thus adapted for mounting to a forestay 36 of a yacht. A foresail support track element 3 is preferably formed from a metal, such as aluminium, or a plastics extrusion to a generally "A" shaped cross-section. Support track 3 is preferably of a composite construction comprising short (relative to the total length) support elements 5, each approximately five (5) meters in length joined end to end by connectors 6. Connectors 6 preferably comprise hollow "D" cross-sectionally shaped aluminium sleeves bridging the junction between adjoining elements 5. The planar faces 30 of connectors 6 engage in transverse slots 7 formed in the ends of support elements 5 at or adjacent the web section thereof. In such position the arcuate wall 34 of a connector 6 extends about the apical sections 32 at the ends of adjoining support elements 5. Transversely aligning apertures 35 are provided in at least one side wall of a connector 6 and the corresponding walls of support elements 5 enabling attachment means, for example, pop-rivets 33 to join the support elements 5 to the connectors 6.

Apical wall section 32 and web section 31 of a support element 5 define a longitudinally extending bore-like cavity 8 by which the support elements 5 can be longitudinally slid and mounted onto the wire stay 36.

In similar and aligning manner planar face 30 and arcuate wall 34 of a connector 6 define a bore 37 therethrough in which stay 36 is accommodated.

Leg sections of the sail support track 3 form two tracks 9 on which sail support slides 10 are slidingly captivated as hereinafter described. Tracks 9 are positioned in adjacent spaced apart parallel relationship, each track 9 comprising an inner reduced width section 52 extending substantially tangentially relative to bore 8 and terminating in a transversely enlarged section 11 forming, at least on the inner face of each leg section 62, an inwardly directed step or shoulder 38 over which a mating arm 47 on a sail support slide 10 can be slidingly captivated. Preferably, as depicted, transverse enlargement 11 forms both inner and outer shoulders 38 such that enlarged section 11 takes the form of a rail.

In practice it has been found that the outer shoulder 38 is not essential. A support track so formed has the appearance of merely comprising a single female track equivalent to groove 39 between tracks 9.

A lowermost support element 5*a* of sail support 3 incorporates a cut-out 14 in the arcuate wall 32. Cut-out 14 is adjacently set-in from the lower end of support element 5*a* and forms an access aperture to bore 8. A primarily cylindrical mounting bush 15 is mounted on stay 36 as to be accommodated in cut-out 14. Bush 15 is anchored to stay 36 preferably by a grub screw 16, mounted in a lateral protusion 40 on bush 15, to impinge on stay 36. Preferably a lead slug 41 or similar element is impinged between stay 36 and grub screw 16, the distortion of slug 41 resulting from the clamping action facilitating in anchoring bush 15 to stay 36. A bridging protective strip 63 preferably covers protusion 40.

Bush 15 is diametrically dimensioned such that the ends thereof provide bearing faces for the adjacent end edges of cut-out 14, thrust washes 17 preferably being provided therebetween. Such mounting longitudinally affixes sail support 3 on stay 36 without preventing articulation of sail support 3 about stay 36. Such is desirable where a jibsail or foresail is mounted to sail support 3 as in the preferred embodiment. Articulation capability is not necessary or desirable where a mainsail is involved.

At the lower end of support element 5*a* a pair of downwardly depending pins 24 are provided to enable alignment between sail support track 3 and a sail loading and unloading magazine 18 as hereinafter described. In mounting sail support 3 to stay 36 as aforesaid support element 5*a* is spaced upwardly clear of the lower end of stay 36 to provide a space or recess for insertion of magazine 18, or at least the upper end thereof, in end to end abuttment with sail support 3. Magazine 18 preferably comprises a short length of aluminium extrusion having at least one longitudinally extending track 9*a* complementary to the track 9 on sail support track 3. Preferably, magazine 18 incorporates two tracks 9*a* of identical shape and geometric disposition relative to one another and the main body of magazine 18 to the shape and disposition of track 9 relative to the main body of sail support 3.

Thus, in cross-section, magazine 18 is shaped similarly to sail support 3, the principal difference being in respect of the, in use, forward positions. Magazine 18 incorporates a channel 23 defined laterally by two longitudinal ribs 42 as compared with bore 8 and arcuate wall section 32 respectively of sail support 3. With stay 36 accommodated along channel 23 tracks 9*a* align with tracks 9. To set this alignment location holes 25 are formed in the ends of ribs 42 to accommodate pins 24. Preferably holes 25 are in the form of longitudinally extending narrow channels formed in ribs 42, such arrangement being in accordance with accepted extrusion techniques.

Locating holes 25 and co-operating locating pins 24 are preferably of a common radial disposition relative to the longitudinal axis of stay 36. In this way magazine 18 can be at least partly rotated about stay 36 to align, for example, the port side track 9*a* magazine 18 with the starboard track 9 of sail support 3. With such an arrangement magazine 18 need only include one track 9*a* or alternatively two or more tracks 9*a* can be provided thereon with each track 9*a* capable of registering in alignment with either track 9 of sail support 3.

Sail support slides 10 are provided to rig a sail 43 on either track 9 of sail support 3 via loading and unloading tracks 9*a* of magazine 18.

Slides 10 preferably comprise substantially "H" shaped metal bodies, preferably cut from a parent extruded strip of that cross-sectional shape. Initially the leg section 44 at one end are inclined outwardly of one another. Resilient "U" section inserts 45, preferably formed from rubber, leather or similar materials, are positioned to line the space between the leg portions 44. In mounting the slides 10 to a sail 43, a luff rope edge 46 thereof is inserted between the leg sections 44 which are then crimped toward one another to impingingly entrap luff rope edge 46 therebetween.

The opposing legs 47, of slides 10 terminate with inwardly directed lips 48 as can be captivated on tracks 9 and 9*a* upon being fed thereonto from the ends thereof.

Slides 10 attached to a sail 43 can be so mounted and stored on a track 9*a* of magazine 18, the slides 10 being in substantially end to end abuttment with one another and the sail 43 at least partially furled in conformity therewith.

Stops are provided adjacent each end of tracks 9*a* to contain slides 10 thereon. A lower, in use, stop 49 preferably comprises a spring pin frictionally retained in transversely disposed and aligned apertures in tracks 9*a*. The upper stop 50 is readily removable and is preferably comprised of a further pair of transversely and aligned apertures in the tracks 9*a* adjacent the upper end thereof and homed in which is an end section of a semi-rigid cord, the opposing end thereof being conveniently anchored to the body of magazine 18. Cord 50 is readily removed clear of tracks 9*a* and has the advantage, compared to, for example, a metal pin, of being sufficiently flexible to avoid, particularly when hanging free, ensnarement with a sail during the raising and lowering thereof.

Mounting means 26 are provided to enable the ready mounting and dismounting of magazine 18 to the end of sail support 3. Mounting means 26 preferably comprises a cup-like body 27 having a bore 28 at the central lower end thereof by and through which cup 27 is mounted to stay 36 at a spacing from the lower end of sail support 3 commensurate to the length of magazine 18. Cup 27 is thus disposed concentrically about stay 36 and is anchored thereto by way of grub screw 29 and slug 20 mounted in a laterally opening internally screw threaded enlargement on the lower end of body 27 in similar manner to the fixing described above in respect of bush 15. A socket element 51 is mounted in cup 27 to also be disposed substantially concentrically about stay 36. Socket element 51 seats on a compression spring 52 to thus spring-load the magazine 18 into engagement with the end of the sail support 3. Spring 52 and socket 51 are located and positioned by stay 36.

A spindle 54 is mounted in a lateral protusion of cup 27 and is biased inwardly of the cup by a spring 56. Spindle end 55 projects into cup 27 directly under socket 51 thereby preventing insertion of socket 51 against spring 52.

The outer end of spindle 54 incorporates a turn knob 57 on an inner face of which there is formed an annular cam face 58 which impinges onto an outward projection 59 of casing 27 By turning knob 57 projection 59 climbs cam 58 causing spindle 54 to withdraw from beneath socket 51 and to thus free the spring loading thereof. Counter-rotation of knob 57 provides for the insertion of spindle 54.

The lower end of magazine 8 includes an enlargement of a substantially hemispherical shape to form a ball element 60 rotatibly accommodable in socket 51.

With spindle 54 withdrawn, ball 60 at the lower end of magazine 18 can be seated in socket 51 with magazine 18 marginally inclined outwardly of stay 36. Magazine 18 and socket 1 can then be depressed against spring 52 enabling magazine 18 to be aligned with sail support 3 and in clearance of locating pins 24. Upon release pins 24 can be homed in apertures 9 to align and locate the tracks 9 and **9*a*. Knob 57 can then be turned to insert spindle 54 preventing longitudinal dislodgement of socket 51 and thus magazine 28. Magazine 18** can be dismounted in a reverse manner.

In use, a sail 43 is stored with a magazine 18 mounted thereto, stop 50 being homed. In readiness for a sail change-over the magazine 18 and sail 43 are mounted to the lower end of sail support 3 as described above. By the appropriate halyard attached to eye 61, sail 43 is raised up corresponding track 9 of sail support 3 when required, stop 50 firstly being removed. Normally such raising of the replacement sail would take place prior to lowering an existing raised sail down the opposing track 9 on to the spare or vacant track **9*a* of magazine 18 in readiness for re-raising or storage with the detached magazine 18**.

It will be appreciated that sail support 3 could integrally incorporate and thus form a stay equivalent to stay 36, such being known. In accordance with this invention, a lower end portion of the track section thereof is removed to provide a spacing to accommodate the magazine.

In an alternative embodiment, in known manner, sail support 3 comprises essentially the two tracks 9 which are fixed by their back face to an aft face of a mast thereby adapting the invention for use with mainsails. The tracks could be integrally incorporated into the masts.

Further, magazine 18 can be of a shallow arcuate longitudinal configuration and mounted to sail support 3 at an angle, the lower end set back from the true longitudinal line, in the form of a branch, the upper end only of the magazine abutting into a recess at the lower end of the sail support. Such an arrangement is also suitable for use with a straight magazine.

What is claimed is:

1. A stay rigged sail change-over magazine comprising: an elongate magazine body incorporating at least two parallel and longitudinally extending sail slide tracks thereon, the tracks terminating coterminously with one end of the magazine body, said one end being formed with magazine-to-sail support alignment means;

a pair of longitudinally spaced apart stops mounted to each track of the magazine which prevent passage of sail slides along the track beyond the stops, with the stop nearest the alignment means on each track being detachable;

and a magazine body mounting means clampable to a stay, said mounting means incorporating a spring loaded magazine-body-end receiving element whereby the magazine body can be detachably mounted between the magazine body mounting means and a lower end of a sail support mounted to the stay, the sail support incorporating parallel sail slide tracks and alignment means complementary to said tracks and said magazine-to-sail support alignment means of said magazine body, whereby the spring loaded element of the magazine mounting means resiliently biases said one end into end-to-end abutting relationship with the sail support, with the tracks of said magazine body in aligned register with the tracks of the sail support.

2. A stay rigged sail support and change-over magazine comprising: an elongate sail support having a body adapted for attachment to a stay in longitudinal conformity therewith;

at least two parallel sail slide tracks extending longitudinally of the support;

sail support to change-over magazine alignment means at a lower end of the support;

a mounting bushing, said bushing being clampable to a supporting stay to prevent longitudinal but not rotary movement of said support on the stay;

and a laterally disposed cut-out in said body, said cut-out positioned to be clear of the tracks and adapted to accommodate said mounting bushing, said bushing retaining the sail support to the stay such that the lower end of the sail support is spaced upwardly clear of the lower end of the stay to provide clearance for receiving a sail change-over magazine therebetween;

a changeover magazine having sail slide tracks and having alignment means at one end, said tracks and alignment means being complementary to the tracks and alignment means of said sail support, said magazine tracks terminating coterminously with said end of said magazine formed with said alignment means and each track of the magazine incorporating a pair of longitudinally spaced-apart stops, said stops preventing the passage of sail slides along the track beyond said stops, the stops nearest said sail support alignment means being detachable; and magazine mounting means clampable to said stay, said mounting means incorporating a spring loaded magazine-end receiving element whereby the magazine can be detachably mounted between said magazine mounting means and said sail support with the spring loading element of said magazine means resiliently biasing said one end of said magazine into end-to-end abutting relationship with said lower end of said sail support, the tracks of said magazine being in aligned register with the tracks of said sail support.

3. A stay rigged sail support and change-over magazine as claimed in claim 2, wherein said sail support is formed from an extrusion of substantially "A" shaped cross-section, the legs thereof forming said sail slide tracks, each track comprising an inner reduced width section terminating with a transversely enlarged portion defining at least one laterally disposed shoulder, whereby a commensurately shaped sail slide can be captivated over the enlarged portion and wherein the apical section defines a longitudinally disposed bore in which a supporting stay can be accommodated to mount the sail support to the stay, the mounting bushing cut-out being provided in the apical section adjacent the lower end of said sail support, and wherein said magazine is formed from a length of extrusion of a substantially "H" shaped cross-section with one pair of legs forming a longitudinal groove in which, when said magazine is installed, a section of a supporting stay can be accommodated such that the longitudinal axes of the stay and of said magazine are substantially common, the opposing pair of legs in the magazine extrusion forming tracks shaped in conformity to the tracks of said sail support.

4. A device as claimed in claim 3 wherein at least one pin extends from the lower end of the sail support and the abutting end of the magazine incorporates corresponding locating hole(s) to accommodate the pin(s) to thereby set the alignment between the tracks of the sail support and the magazine.

5. A device as claimed in claim 4 wherein the locating hole(s) and pin(s) are disposed radially common relative to the longitudinal axis of the stay to provide that with part rotation of the magazine about the stay the magazine track(s) can be aligned with the tracks or a selected track of the sail support.

6. A device as claimed in claim 3 wherein the sail support is of a composite construction comprising short lengths of the said extrusion having transverse slits at the ends thereof, "D" shaped sleeves, forming connectors extending between adjoining element ends, the planar face of a connector being accommodated in the slits and the arcuate wall thereof extending about the apical end sections of the sail support elements, fixing means being provided to anchor the sail support elements to the connectors.

7. A stay rigged sail support and change-over magazine as claimed in claim 2, wherein the detachable stops each comprise a length of semi-rigid cord anchored at one end to said magazine and with the free end terminating section thereof being insertable in a pair of transversely disposed and aligned apertures formed through each track.

* * * * *